United States Patent [19]

Focke et al.

[11] Patent Number: 4,495,746

[45] Date of Patent: Jan. 29, 1985

[54] PACKAGING APPARATUS FOR PRODUCING AND FEEDING BLANKS TO A PACKAGING STATION

[75] Inventors: Heinz Focke; Kurt Liedtke, both of Verden, Fed. Rep. of Germany

[73] Assignee: Focke & Co., Verden, Fed. Rep. of Germany

[21] Appl. No.: 398,148

[22] Filed: Jul. 14, 1982

[30] Foreign Application Priority Data

Aug. 11, 1981 [DE] Fed. Rep. of Germany ..... 3131687

[51] Int. Cl.[3] ..... B65H 41/00; B65H 5/22

[52] U.S. Cl. ..... 53/389; 83/100; 83/112; 83/152; 83/422

[58] Field of Search ..... 83/152, 98–100, 83/112, 422; 53/389; 271/197

[56] References Cited

U.S. PATENT DOCUMENTS 3,075,325 1/1963 Liedtke ..... 53/389 X
3,355,166 11/1967 Plumb ..... 53/389 X
4,080,856 3/1978 Shearon ..... 83/99
4,114,355 9/1978 Davies et al. ..... 53/389
4,151,699 5/1979 Focke et al. ..... 83/152 X

FOREIGN PATENT DOCUMENTS 1169361 4/1964 Fed. Rep. of Germany .
2949685 6/1981 Fed. Rep. of Germany .

*Primary Examiner*—James M. Meister
*Attorney, Agent, or Firm*—Sughrue, Mion, Zinn, Macpeak and Seas

[57] ABSTRACT

The efficient machine conveyance of inexpensive, very thin-walled packaging material, especially plastic foils, presents special problems because of the low degree of firmness of these foils. In the present apparatus, the front end of a sheet of such material and blanks severed from it are transported continuously by suction air conveying members. These consist of a suction drum and perforated belts directly adjoining the drum, with no interruption occurring in the retention of the packaging material.

16 Claims, 9 Drawing Figures

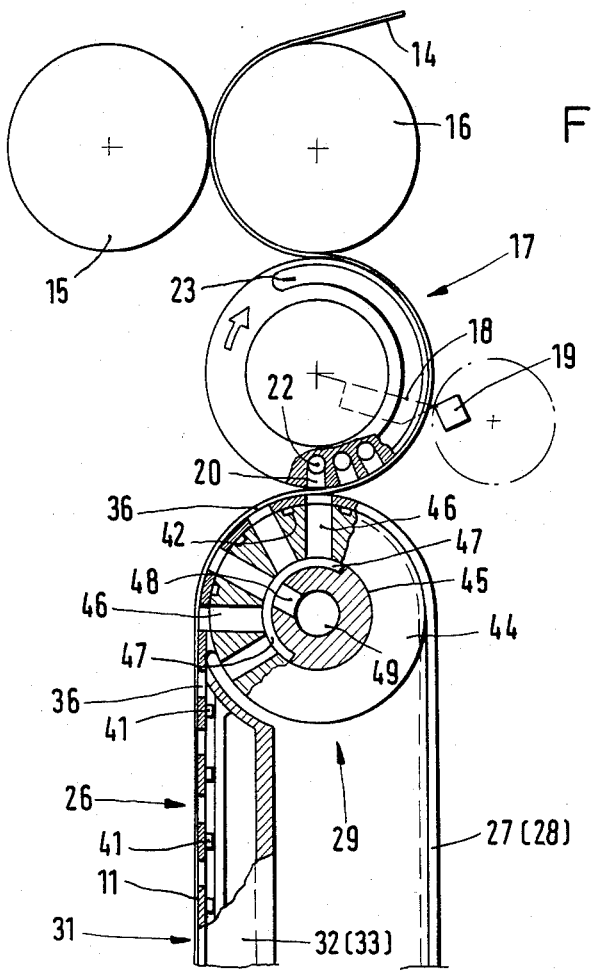
Fig. 3
Fig. 4
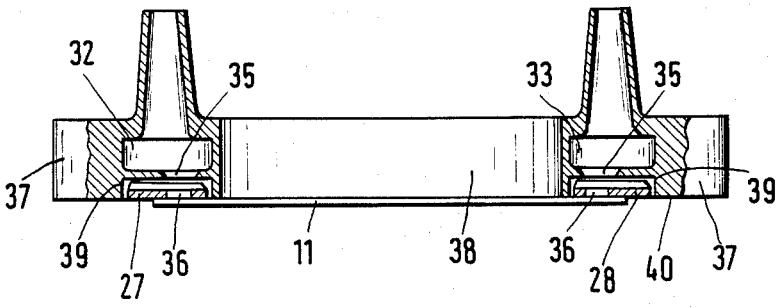

PACKAGING APPARATUS FOR PRODUCING AND FEEDING BLANKS TO A PACKAGING STATION

BACKGROUND OF THE INVENTION

The invention relates to a packaging apparatus for producing blanks by severing them from a sheet of material and for feeding them to a packaging station by means of a blank-conveyor which consists of revolving laterally perforated belts with a conveying side for the blanks which is under a vacuum as a result of suction chambers arranged on the rear face.

For the processing of packaging materials with "critical" properties in packaging technology, special measures are necessary to fix sufficiently the foils or blanks made from them during conveyance. At the same time it is important to guarantee uninterrupted retention both of the continuous sheet of material and of the blanks severed from it, until they are wrapped round the article to be packaged.

A first solution to this problem can be found in German Pat. No. 1,169,361 issued on Apr. 30, 1964. In this proposal the sheet of material is fed to a suction roller, on the outer shell surface of which suction bores open. The blanks are severed from the sheet of material on this suction roller by a revolving severing knife. The individual blanks are then transferred from the suction roller to lateral suction discs on the same axis, which likewise fix the blank laterally by means of suction bores. The article (pack) can be moved through between these suction discs in a radial direction, specifically carrying with it the blank which is pulled off from the suction discs as a result of slipping.

The use of suction discs as a retaining and conveying member for the blanks has proved unfavourable because they are expensive to produce and are tied to specific maximum dimensons. In addition, when the blank (of appropriately large dimensions) loops substantially round the suction discs, it becomes more difficult for the conveyed pack to pull it off from the suction discs.

Consequently, more recent solutions (U.S. Pat. No. 4,151,699 and German Offenlegungsschrift No. 2,949,685 of Dec. 11, 1979) work with laterally perforated belts, the conveying side of which is likewise exposed via suction chambers fixed in place to a vacuum which retains the blank and carries it along. A vertical plane conveying path for the blanks is possible by means of the perforated belts. This path can have sufficient length for separating the necessary conveying and packaging members from one another. Also, it is easier to pull a blank off from the vertical perforated belts by means of a pack conveyed transversely to it.

However, in the known apparatuses with perforated belts of this type, the problem of severing the blanks from the sheet of material, whilst keeping them fixed continuously, has not yet been solved in the best possible way.

SUMMARY OF THE INVENTION

Consequently, the object on which the invention is based is to propose measures, by means of which, on the one hand, uninterrupted conveyance of the sheet of material and of the severed blanks until they are received by a pack or the like is guaranteed, with, at the same time, a simple and functionally reliable construction, and, on the other hand, a straightforward cut severing the blank completely from the sheet of material can be made.

To achieve this object, the apparatus according to the invention is characterised in that located in front of the blank-conveyor is a suction drum known per se, in the region of which the blanks can be severed from the sheet of material and by means of which the blanks can be transferred directly to the perforated belts. In particular, the suction drum is located in the region of an (upper) deflecting roller for the perforated belts, in such a way that the peripheral surface of the suction drum or the blank conveyed thereon can be transferred directly to the peripheral surface of the deflecting roller of the perforated belts or to the belts themselves. At the same time, the invention ensures that the deflecting roller for the perforated belts is subjected to suction air at least in a peripheral region serving for transporting the blank.

In the invention, therefore, two different conveying systems, namely a suction roller for making the severing cut when the blank is produced, on the one hand, and perforated belts for conveying the blank up to the packaging station, on the other hand, are placed in such a spatial relationship to one another that the blank severed on the suction drum can be transferred directly and without an intermediate conveyor to the suction belts appropriately closely adjacent thereto. The transition from conveyance of the blanks along a path in the form of a circular arc (over part of the periphery of the deflecting roller) to a plane conveying path (by means of the perforated belts) takes place in an especially favourable way in the invention since the perforated belts already run underneath the blank in the region of the deflecting roller.

The suction air retaining the blank on the deflecting roller can be brought up to the blank in various ways. According to an advantageous embodiment, the deflecting roller is provided with (radial) suction bores which preferably correspond to suction holes in the perforated belts. In this case, the suction air is transferred to the blank through or via the perforated belts in the region of the deflecting roller also.

According to an embodiment which is also advantageous, the suction chambers assigned to the perforated belts are prolonged into the region of the deflecting roller for the perforated belts, to form suction segments in the form of circular arcs. These extend in a peripheral groove of the deflecting roller in such a way that the outwardly open side of the suction segments can take hold of the blank (directly or via the perforated belts).

Finally, it is possible to place the suction drum directly on the vertical conveying side of the perforated belts, in such a way that the severed blanks are transferred from the suction drum directly to the perforated belts conveying downwards.

BRIEF DESCRIPTION OF THE DRAWINGS

FIG. 3 shows, in a side view and in vertical section, the upper region of the apparatus according to FIGS. 1 and 2 on an enlarged scale, FIG. 4 shows a horizontal section through the apparatus in the region of perforated belts and suction chambers, on an enlarged scale.

DETAILED DESCRIPTION OF THE PREFERRED EMBODIMENTS

Figure 1:
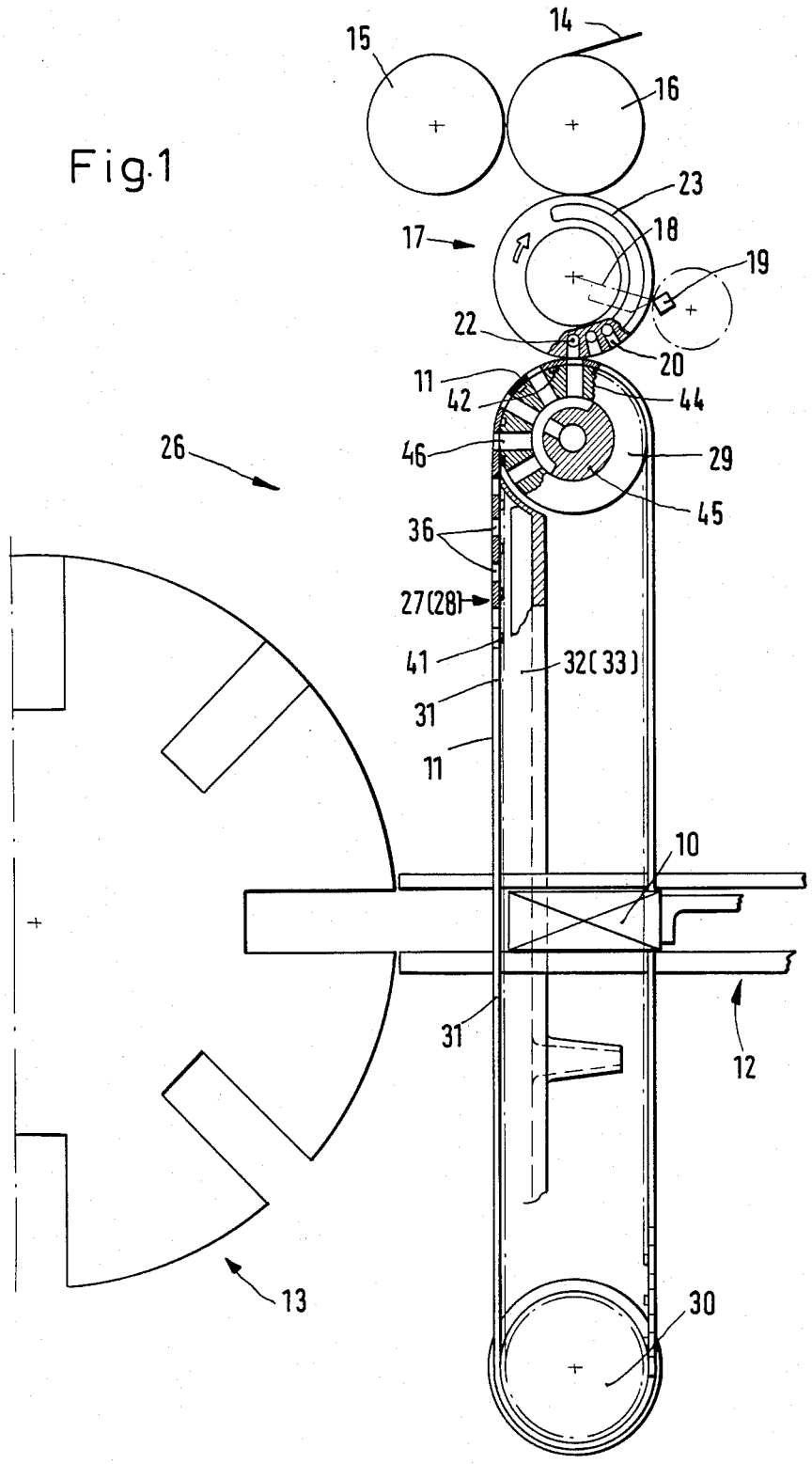
FIG. 1 shows, partially in vertical section, a simplified side view of an embodiment of the apparatus.
Figure 2:
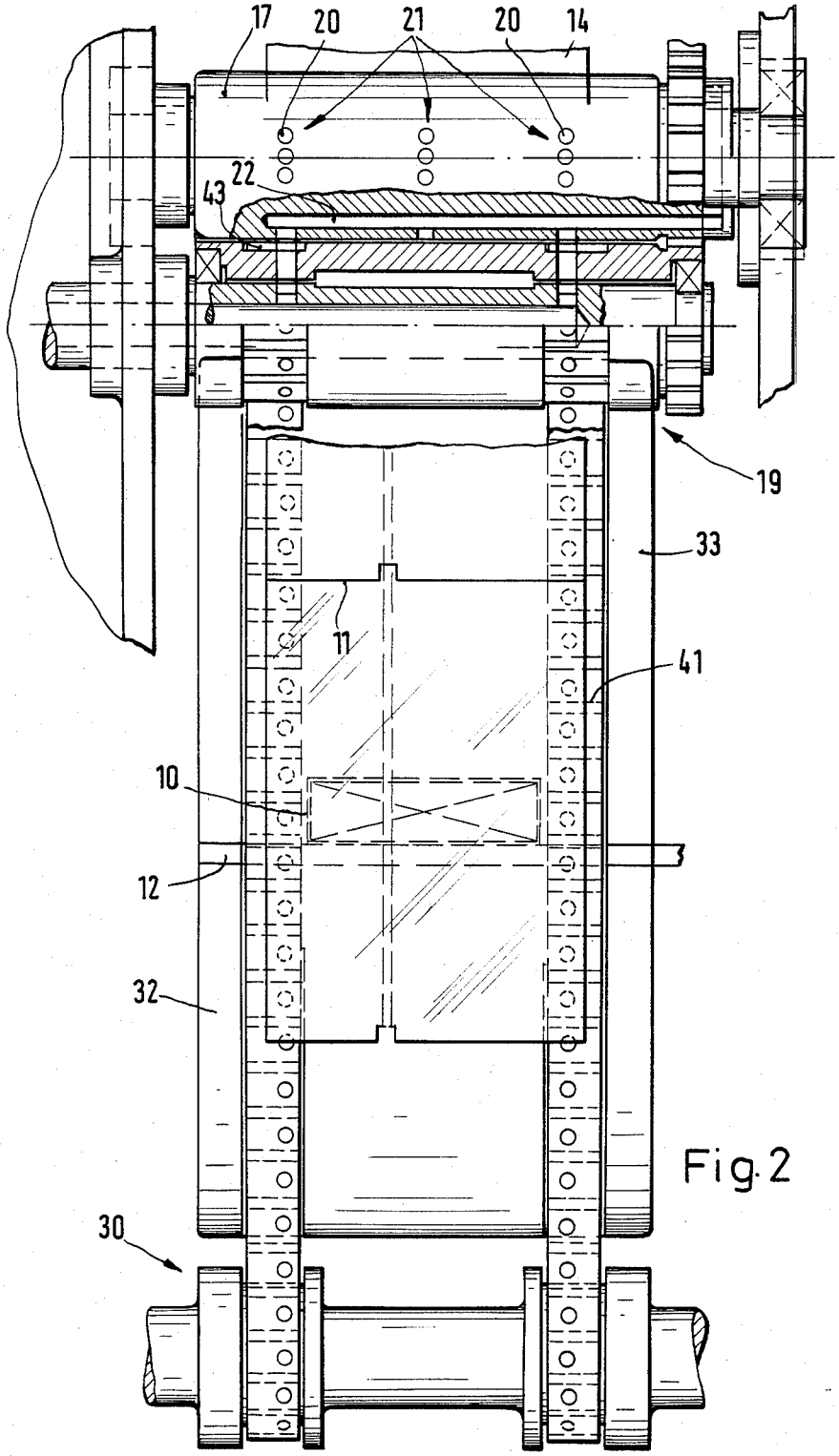
FIG. 2 shows, also partially in vertical section, a front view of the apparatus according to FIG. 1, offset 90°.

The devices illustrated are parts of a packaging machine for producing cigarette packs 10 provided with an outer wrapping of an inexpensive plastic foil which presents packaging problems. For this purpose, a blank 11 of packaging material is kept ready on a pack track 12 in a plane transverse to the direction of transport of the cigarette pack 10, in such a way that the blank 11 wraps itself in the form of a U round the cigarette pack 10 as a result of the relative movement. The cigarette pack provided with a blank 11 in this way is then conveyed into a folding turret 13 which makes the further necessary folds of the blank 11 in a known way.

The blanks 11 are severed successively from a sheet of material 14 conveyed continuously (or intermittently). This sheet of material is conveyed by means of a pair of drawing rollers 15, 16 mounted above following conveying members. After the sheet of material 14 has been conveyed along approximately half the periphery of one drawing roller 16, it is transferred to an adjoining, parallel axis suction drum 17.

On the suction drum 17, the blank 11 is severed from the following sheet of material 14. In the present embodiment, an approximately radially directed severing knife 18 is embedded in the suction drum 17 in such a way that its outer cutting edge projects beyond the shell surface of the suction drum 17. The severing cut is made by means of a revolving counter-knife 19 at a predetermined and recurring cutting point, so that blanks of always the same length are severed. The above-mentioned severing device can also be designed in a different way.

The revolving suction drum 17 is equipped with radial suction bores 20 which open onto the shell surface of the suction drum 17 in several, preferably three suction rows 21 located at a distance from one another and which, when subjected appropriately to suction air, fix the sheet of material 14 or the blank 11. The suction bores 20 of the three suction rows 21 are each connected to common parallel axis suction channels 22 which lead to an axial end of the suction drum 17 and communicate periodically with a suction groove 23 formed in a fixed distributor disc 24 mounted next to the suction drum 17. The suction groove 23 extends over the entire approximately semi-circular conveying region of the sheet of material 14 or of the blank 11 on the suction drum 17. Advantageously, in the lower region, there is formed in the distributor disc 24 a vent bore 25 (FIG. 9) which is separate from the suction groove 23 and which, as a result of venting the suction channels 22 and consequently the suction bores 20 in this region, makes it easier to transfer the blank 11 to a following blank-conveyor 26.

By means of this blank-conveyor 26, the blank 11 is transported in a straight line, namely in a vertical plane. For this purpose, the blank-conveyor 26 consists of two perforated belts 27 and 28 arranged at a distance from one another. These are guided over upper and lower deflecting rollers 29 and 30. In the present case, the arrangement is such that the deflecting rollers 29 and 30 are disposed approximately at equal distances above and below the pack track 12.

Figure 6:
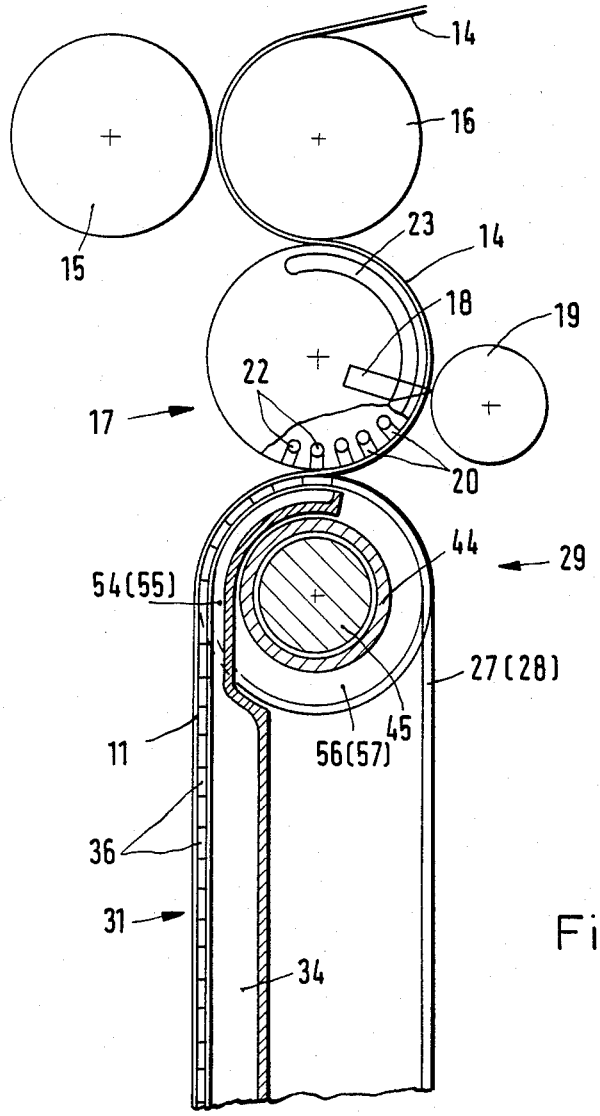
FIG. 6 shows a representation corresponding to FIG. 3 of another embodiment of the apparatus.
Figure 8:
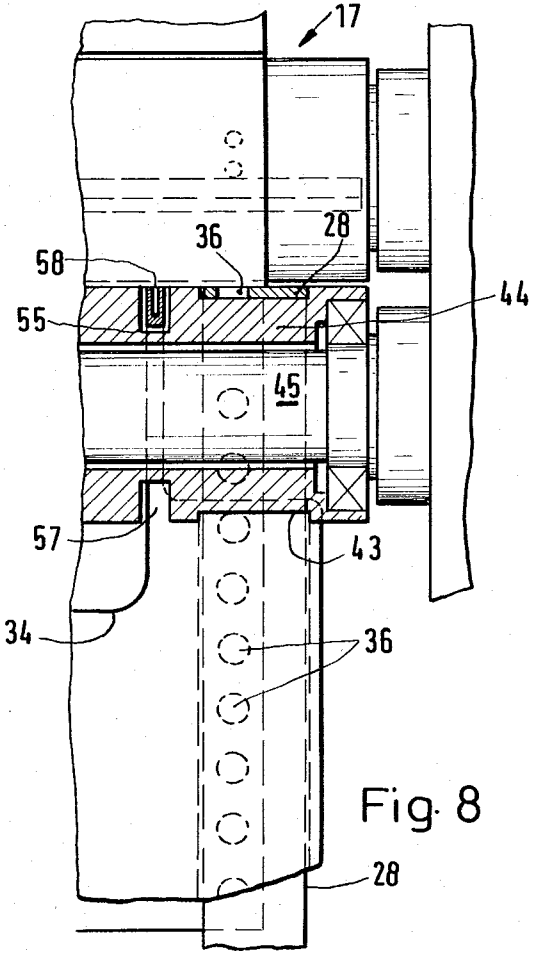
FIG. 8 shows a representation corresponding to FIG. 7 of a modified embodiment of the apparatus.
Figure 7:
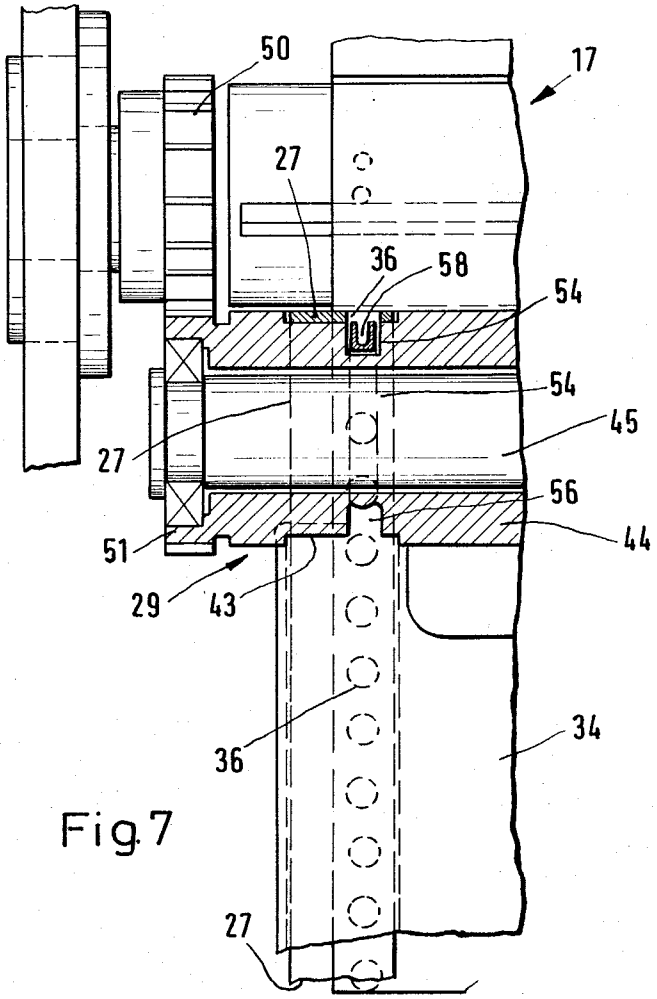
FIG. 7 shows a front view offset 90°, partially in section, of the embodiment according to FIG. 6.

The perforated belts 27, 28 are subjected to suction air in the region of a conveying side 31, specifically either by means of individual elongate suction chambers 32 and 33 for each conveying side 31 or by means of a common suction box 34 (FIGS. 6, 7 and 8). The suction chambers 32, 33 are provided on the side facing the conveying side 31 with orifices or a continuous suction slit 35 which is covered by the conveying side 31 of the perforated belts 27, 28. In the region of the suction slit 35, the perforated belts 27, 28 are provided with suction holes 36 which enable the vacuum to be made effective by means of the suction chambers 32, 33 or the suction box 34 on the opposite face of the conveying side 31, so that the blank 11 is fixed during transport.

As is evident especially from FIG. 4, in this embodiment the suction chambers 32 and 33 are formed in vertical supporting elements 37, between which a recess 38 is formed for pushing through the cigarette pack 10. During this pushing-through movement, the blank 11 is pulled off from the conveying sides 31 of the perforated belts 27,28 by the cigarette pack 10.

The perforated belts 27, 28 run in trough-like depressions 39 in the suction chambers 32, 33 or the suction box 34. The narrow depressions 39 are calculated so that the perforated belts 27, 28 running in them terminate approximately flush with the contact surface 40 facing the blank 11. The suction holes 36 in the perforated belts 27, 28 and the suction slits 35 for the suction chambers 32, 33 are arranged offset inwards in relation to the longitudinal centre planes of these parts.

The perforated belts 27, 28 are provided, on the inner face turned towards the deflecting rollers 29 and 30, with transversely directed rib-like elevations 41, as a result of which the perforated belts 27, 28 are designed as toothed belts. At least the upper deflecting roller 29 is equipped with corresponding depressions 42 into which the elevations 41 engage positively. Because of this, an exact movement of the perforated belts 27, 28 which is slip-free in relation to the deflecting rollers 29, 30 is guaranteed. The depressions 42 are formed in the region of turned-in portions 43 of the deflecting rollers 29, 30. These turned-in portions 43 or flat grooves are designed so that the perforated belts 27, 28 fit in them and terminate essentially flush with the shell surface of at least the deflecting roller 29. A suction hole 36 is located between every two elevations 41.

The present embodiments are designed so that from the take-over of the sheet of material 14 by the suction drum 17 up to the transfer of the blank 11 to the cigarette pack a continuous and uninterrupted fixing of the sheet of material 14 and of the blank 11 to the conveying members concerned by means of suction air is guranteed. The transfer of the blanks 11 formed on the suction drum 17 to the blank-conveyor 26 is achieved in a special way.

In the embodiment according to FIG. 1 and the following figures, the upper deflecting roller 29 of the blank-conveyor 26 is subjected to suction air in the region of the shell surface, specifically at least in a peripheral region serving for conveying the blank 11. Preferably, the suction air is here brought up to the blank 11 via the perforated belts 27, 28 so that the blank 11 is already decisively transported by the perforated belts 27, 28 in the region of the deflecting roller 29.

In this embodiment, the deflecting roller 29 consists of a hollow cylinder 44 which is mounted rotatably on a fixed supporting axle 45. This has, at the same time, the task of supplying vacuum to the deflecting roller 29. The hollow cylinder 44 is equipped with radially directed suction bores 46 which respectively open onto the shell surface of the hollow cylinder 44 in the region of the suction holes 36 in the perforated belts 27, 28. The suction bores 46 are connected to a vacuum system in the supporting axle 45, namely to a segmental groove 47 extending in a peripheral direction in the region of the suction bores 46. This is arranged and calculated so that the suction bores 46 are connected to the segmental groove 47 over the region of transport for the blank 11. This segmental groove is, in turn, connected via a radial bore 48 to a central axial bore 49 in the supporting axle 45. Consequently, by connecting the latter to a vacuum source, the segmental groove 47 is subjected constantly to suction air. The blank 11 is taken over by the deflecting roller 29 in the upper region of the latter in the closest proximity to the suction drum 17. Conveyance on the deflecting roller 29 extends approximately along a quarter circle.

Figure 5:
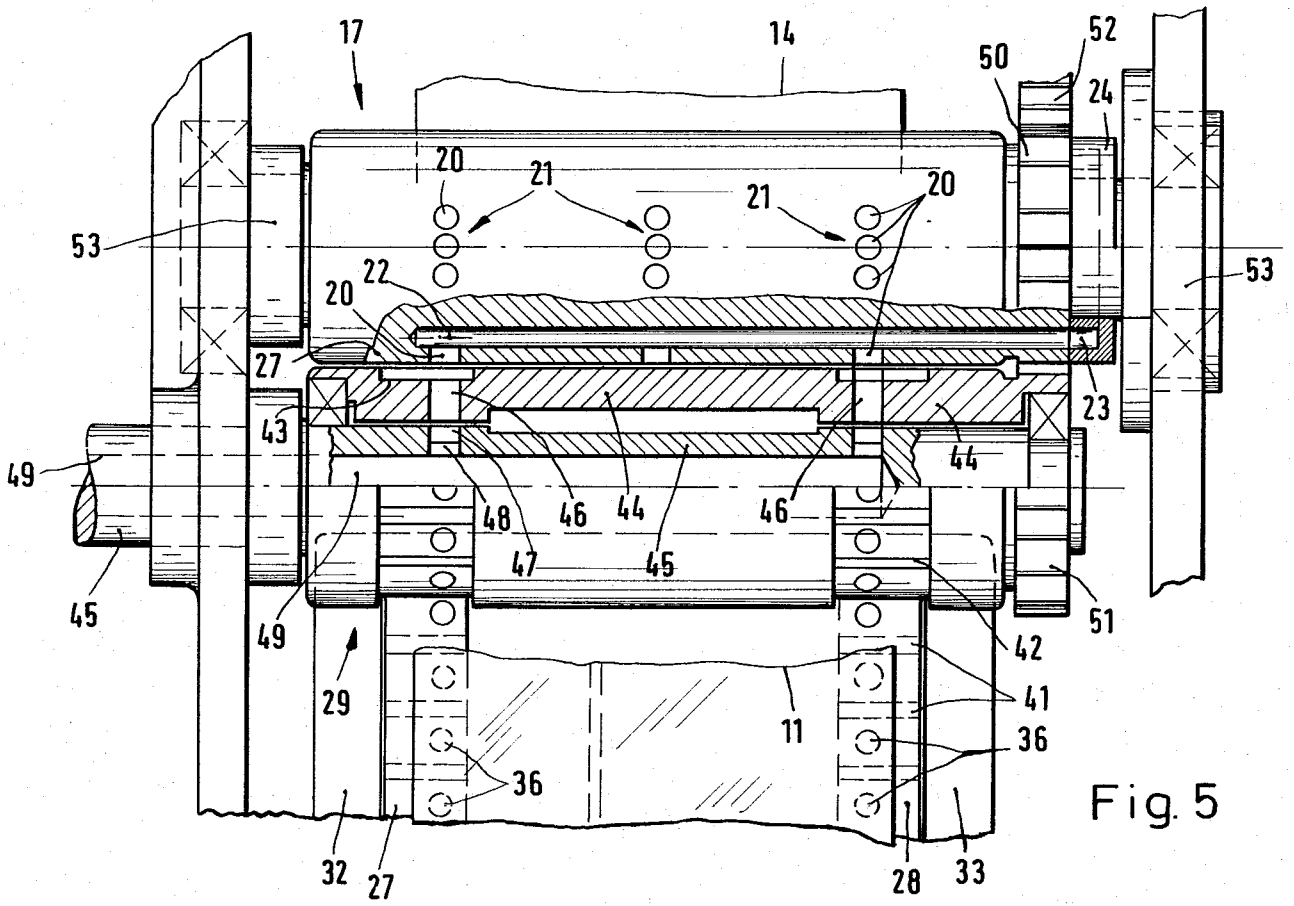
FIG. 5 shows a front view relating to the detail according to FIG. 3 offset 90°.

The design of the transport apparatus described this far permits a favourable arrangement of the conveying members, in such a way that the sheet of material and blanks are transported, until they are received by the perforated belts, on arcuate tracks adjoining one another. For this purpose, in the embodiments according to FIGS. 1 to 8, the deflecting roller 29, suction drum 17 and drawing roller 16 are arranged above one another in a common axial plane. As a result, a favourable synchronous drive of these conveying members is also possible, as is evident especially from FIG. 5. The suction drum 17 and deflecting roller 29 are directly engaged operatively with one another via gear wheels 50, 51. A further gear wheel 52, serves for driving the drawing roller 16. The suction drum 17 is mounted at both ends on a continuous axle 53. Here, the supporting axle 45 of the deflecting roller 29 is mounted on one side.

The embodiment according to FIGS. 6 to 8 is, in principle, designed in the same way as that according to FIGS. 1 to 5. Here, the blank 11 is fixed to the upper deflecting roller 29 by means of suction air in a different way. As is evident especially from FIG. 6, the suction box 34 provided here is prolonged into the region of the deflecting roller 29, specifically by narrow suction segments 54, 55, shaped in the form of circular arcs and adjoining the suction box 34. These are designed, here, as relatively narrow trough-like air-conveying members of actually U-shaped cross-section. The fixed suction segments, 54, 55 extend in correspondingly shaped and dimensioned peripheral grooves 56 and 57 respectively in the deflecting roller 29. The differences in dimension are selected so that the deflecting roller 29 is freely rotatable relative to the suction segments 54, 55. The radially outer side of the suction segments 54,55 is open, thus forming a suction slit 58.

In the embodiment according to FIG. 7, the suction segments 54 extend underneath the perforated belts 27, 28, namely in the region of the air suction holes 36. Here, therefore, in a way similar to the embodiment according to FIGS. 1 to 5, the perforated belts 27, 28 are subjected to suction air in the region of the deflecting roller 29 also, so that they can even here fulfil their conveying and fixing function in relation to the blank.

In the embodiment according to FIG. 8, fixing of the blank and the conveyance thereof are separated from one another in the region of the deflecting roller 29. Here, the suction segments 55 are arranged offset laterally, namely inwards, in relation to the perforated belts 27, 28. For this purpose, the suction segments 55 terminate essentially flush with the shell surface of the deflecting roller 29, so that here the suction slits 58 can act directly on the blank 11.

Moreover, here, the conveying members 16, 17, 29 are in the same or similar positions relative to one another as in the embodiment previously described. The suction box 34 is designed in a similar way to the suction chambers 32, 33 as regards the guidance of the perforated belts 27, 28.

Figure 9:
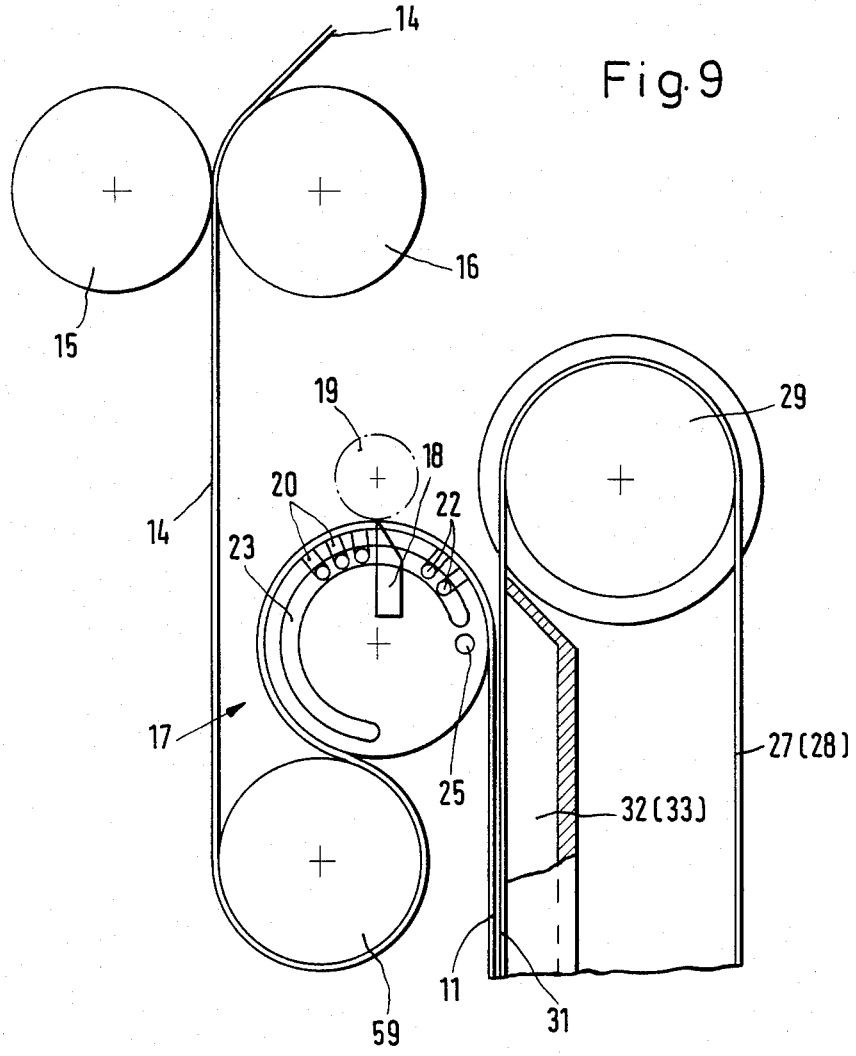
FIG. 9 shows a representation corresponding to FIG. 3 and FIG. 6 of a further embodiment.

FIG. 9 shows an alternative embodiment in which the blanks 11 produced likewise by means of a severing cut on the suction drum 17 are transferred directly by the suction drum 17 to the perforated belts 27, 28 in the region of the (vertical) conveying side 31. For this purpose, the suction drums 17 is mounted underneath the upper deflecting roller 29 closely adjacent to the perforated belts 27, 28 in the upper region of the conveying side 31, in such a way that the blanks 11 running off from the periphery of the suction drum 17 are transferred directly to the conveying side 31 of the perforated belts 27, 28.

Located in front of the suction drum 17 in the conveying direction is a separate additional feed roller 59 which is located approximatly underneath the suction drum 17 and, as a result, provides the sheet of material 14 and the blank 11 with a generally larger surface of contact against the suction drum 17 (approximately three quarters of the periphery). The drawing rollers 15, 16 are arranged correspondingly offset laterally, specifically above the deflecting roller 29. An especially accurate and fault-free guidance of the sheet of material 14 and consequently of the blank 11 is thereby guaranteed even at high speeds.

Moreover, the perforated belts 27, 28 and deflecting roller 29 have a similar design to those of the preceding embodiments.

We claim:

1. A packaging apparatus for severing successive blanks (11) of desired length from a continuous web (14) of thin and delicate wrapping material and for individually conveying the blanks in succession to a packaging station (12, 13), comprising:

(a) a rotatably driven, perforate suction drum (17), (b) means (15, 16) for supplying said web to the suction drum, (c) transverse severing means (18, 19) operatively associated with the suction drum for cutting the web into successive blanks, (d) means (20–24) for applying a vacuum to an outer surface of the suction drum over a predetermined peripheral zone of travel thereof to positively retain the web and blanks thereon throughout said zone, and (e) a blank conveyor (26) disposed between the suction drum and the packaging station, and comprising:

(1) a pair of transversely spaced, parallel, endless, commonly rotatably driven, perforated (36) belts (27, 28), (2) respective upper and lower, parallel axes deflecting rollers (29, 30) mounting said belts, and (3) suction means disposed behind the belts along a conveying run thereof for applying a vacuum thereto to positively but releasably retain the blanks thereon throughout said run, (f) the suction drum being mounted such that a leading end portion of the peripheral zone thereof, in the direction of rotation, adjoins a trailing end portion of the conveying run of the belts to ensure the positive and continuous retention of the blanks without deformation during the transfer thereof from the drum to the belts, and (g) the packaging station being disposed sufficiently downstream of a transfer zone between the drum and belts that trailing ends of severed blanks have left said transfer zone before central portions of said blanks arrive at said packaging station.

2. Apparatus according to claim 1, wherein the suction drum abuts the perforated belts in the region of the upper deflecting roller.

3. Apparatus according to claim 1, wherein the suction drum abuts the perforated belts in the region of a conveying run (31) thereof.

4. Apparatus according to claim 1, further comprising a vent bore (25) operatively associated with the drum for terminating the drum vacuum just beyond the region of the transfer of the blanks to the belts.

5. Apparatus according to claim 1, wherein the deflecting roller (29) is subjected to suction in a peripheral region thereof for transporting the blanks.

6. Apparatus according to claim 5, wherein suction air is generated on the periphery of the upper deflecting roller in two spaced, groove segment regions (43) in communication with the perforated belts.

7. Apparatus according to claim 5, wherein the upper deflecting roller has a plurality of radial suction bores (46) which correspond to and cooperate with suction bores (36) in the perforated belts.

8. Apparatus according to claim 7, wherein the suction bores are subjected to suction air via an axially extending central bore (49) in the upper roller.

9. Apparatus according to claim 7, wherein the suction bores are connected to a vacuum source in a central bore of the roller only in a peripheral region thereof which serves to transport the blanks.

10. Apparatus according to claim 7, wherein the upper deflecting roller comprises a hollow cylinder (44) rotatably mounted proximate the radial suction bores (46) on a fixed support axle (45) having a central bore (49) subjected to suction.

11. Apparatus according to claim 10, wherein the support axle has an outwardly open segmental groove (47) which extends in a peripheral direction and with which the suction bores communicate, said groove communicating with the central bore via a radial bore (48).

12. Apparatus according to claim 1, wherein suction air is communicated to the blanks via the perforated belts by fixed suction segments (54, 55) extending partially around the periphery of the upper deflecting roller, said segments being open in a radially outward direction.

13. Apparatus according to claim 12, wherein the suction segments are of U-shaped cross-section and extend in peripheral grooves (56, 57) in the deflecting roller, and terminate flush with the peripheral surface of the roller.

14. Apparatus according to claim 13, wherein the suction segments are continuations of suction chamber means (32, 33 34); disposed behind the belts.

15. Apparatus according to claim 1, wherein the suction drum is located directly above the upper deflecting roller (29), and one supply roller (16) of a pair of supply rollers (15, 16) is located directly above the suction drum in a common vertical axial plane.

16. Apparatus according to claim 1, wherein the perforated belts have rib-like elevations (41) which engage positively in corresponding depressions (42) in the deflecting rollers, one suction hole (36) being located between every two successive elevations (41).

* * * * *